US008157349B2

(12) United States Patent
Sanada et al.

(10) Patent No.: US 8,157,349 B2
(45) Date of Patent: Apr. 17, 2012

(54) METHOD OF CLEANING HEAD AND INKJET RECORDING APPARATUS

(75) Inventors: Mikio Sanada, Kawasaki (JP); Nobuyuki Matsumoto, Tokyo (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 849 days.

(21) Appl. No.: 11/767,830

(22) Filed: Jun. 25, 2007

(65) Prior Publication Data

US 2007/0247484 A1 Oct. 25, 2007

Related U.S. Application Data

(63) Continuation of application No. PCT/JP2005/023850, filed on Dec. 27, 2005.

(30) Foreign Application Priority Data

Dec. 28, 2004 (JP) ..... 2004-381749
Aug. 15, 2005 (JP) ..... 2005-235405

(51) Int. Cl.
*B41J 2/165* (2006.01)

(52) U.S. Cl. ..... 347/28; 347/33; 347/45

(58) Field of Classification Search ..... 347/20–36, 347/45, 5, 9
See application file for complete search history.

(56) References Cited

U.S. PATENT DOCUMENTS 5,905,514 A 5/1999 Rhoads et al.
5,914,734 A * 6/1999 Rotering et al. ..... 347/28
5,969,731 A 10/1999 Michael et al.
6,074,040 A * 6/2000 Usui et al. ..... 347/45
6,145,953 A 11/2000 Medin
6,224,186 B1 5/2001 Johnson et al.
6,520,621 B1 2/2003 Eckard et al.
2004/0207684 A1 10/2004 Plymale et al.

FOREIGN PATENT DOCUMENTS

| | | |
|---|---|---|
| EP | 0 856 404 | 8/1998 |
| JP | 59-83664 | 5/1984 |
| JP | 10-138502 | 5/1998 |
| JP | 10-138503 | 5/1998 |
| JP | 10-151759 | 6/1998 |
| JP | 10-315487 | 12/1998 |
| JP | 11-254692 | 9/1999 |
| JP | 2000-203037 | 7/2000 |
| JP | 2004-338223 | 12/2004 |

* cited by examiner

*Primary Examiner* — Lam S Nguyen

(74) *Attorney, Agent, or Firm* — Fitzpatrick, Cella, Harper & Scinto

(57) ABSTRACT

A method of a cleaning of an ejection face by supplying a head liquid on the face of an inkjet head provided with ink ejection openings and then by performing a wiping operation. Sufficient cleaning is achieved by appropriately specifying relative relationships among the surface tensions of the face, the ink and the head liquid, and by efficiently and surely removing an ink residue from the face. By supplying the head liquid to the ink residue on the face, both are mixed with each other, and thereby the ink residue is incorporated into the head liquid. In this respect, by using the ink and the head liquid both having a surface tension higher than that of the face, a wetting of a dissolved matter of the ink residue with respect to the face is reduced, and the dissolved matter of the ink residue is smoothly moved by the wiping operation.

5 Claims, 11 Drawing Sheets

METHOD OF CLEANING HEAD AND INKJET RECORDING APPARATUS

BACKGROUND OF THE INVENTION

1. Field of the Invention

The present invention relates to a method of cleaning an inkjet head and an inkjet recording apparatus. The present invention specifically relates to a technology for efficiently removing an ink residue and the like adhered on a surface (hereinafter also referred to as ejection face) on which an ink ejection openings of an inkjet head (hereinafter also referred to as a recording head or simply a head) are formed to clean the surface.

2. Description of the Related Art

A clean-up (cleaning) technique for a recording head which ejects an ink is a very important factor of an inkjet recording method because the method is the system in which input image data is converted to the output image using a liquid ink as a medium. Main problems in requiring the cleaning are briefly described as follows.

An ink ejection recording head directly ejects an ink through a fine nozzle (hereinafter, as such collectively referred to as an ejection opening, a liquid passage communicated therewith, and an element for generating energy utilized to eject ink unless otherwise stated) to a recording medium. Accordingly, the ejected ink hits against the recording medium and bounces back, and, in addition to the main ink involved in the recording when the ink is ejected, fine ink droplets (satellites) are ejected and drift in the atmosphere in some cases. Then, these droplets become ink mists, and, in some cases, adhere around the ink ejection opening of the recording head. Furthermore, dust drifting in the air may sometimes adhere thereto. Subsequently, the ejected main ink droplets are pulled by these attached matters, thereby the ink ejection direction is deflected, i.e., the main ink droplets are blocked from going straight in some cases.

Then, as a cleaning technique for solving this problem, an instrument called a wiping is employed to remove attached matters in the inkjet recording apparatus. The instrument wipes, at a predetermined timing, the ejection face of the recording head by means of a wiping member (wiper) made of an elastic material such as rubber.

Meanwhile, for the purpose of improving the recording density, water-resistance, light-resistance and the like of a recorded matter, an ink containing pigment components as a color material (pigment-based ink) has recently been used in many cases. The pigment-based ink is made by dispersing, in water, the color material which is originally solid by introducing a dispersant or a functional group on the surface of the pigment. Accordingly, the dried matter of the pigment ink formed by evaporating and drying the water content in the ink on the ejection face damages the ejection face seriously as compared to the dried sticky matter of a dye-based ink in which a color material itself is dissolved at a molecular level. A characteristic is also recognized that a high molecular compound used to disperse the pigment in a solvent tends to be adsorbed on the ejection face. This is a problem which occurs even in inks other than the pigment-based one in a case where a reaction liquid is added to an ink for the purpose of controlling the viscosity of the ink, improving light-resistance and for others, resulting in the presence of a high molecular compound in the ink.

To solve these problems, in Patent Documents 1 and 2, disclosed are techniques for removing an accumulated matter by applying a head liquid of nonvolatile solvent on the ejection face to reduce the wear of a wiper and dissolve the ink residue accumulated on the recording head in wiping the recording head. Moreover, the adhesion of a foreign matter to the recording head is prevented by forming a thin film of the head liquid on the recording head, and wiping easiness is improved by these. A construction in which the head liquid used in these wiping is stored in the body of a printer is employed.

In Patent Document 3, it is disclosed that wiping operations are performed on the ejection face of the head after a head liquid composed of nonvolatile solvent is applied on a wiper.

In addition, in Patent Document 4, it is disclosed that a dissolved liquid is sprayed on the ejection face, and thereby insolubilized matters adhered on the ejection face are removed using a wiper.

Furthermore, in Patent Document 5, it is disclosed that wiping operations are performed by dissolving ink residues on a head in a nonvolatile ink solvent held on a wiper.

The present inventors applied nonvolatile solvents on ejection faces by the methods disclosed in the above Patent Documents to verify the effect of the cleaning process. It was then found that some constituent materials of the recording head or some inks caused the removal of the accumulated matter by means of dissolving the ink residues or the targeted cleaning of the ejection face to be insufficiently performed, and that new problems occurred. To be more specific, it was found that the high molecular compound components in the ink residue were once dissolved by the head liquid, but that thereafter the dissolved high molecular compounds were more uniformly adhered on the surface of the recording head, causing changes in the surface properties which the recording head inherently has. In other words, this is because a thin film composed of the high molecular compounds is formed on the entire ejection face, and thereby the properties of the high molecular compounds control the surface properties of the recording head. In general, the properties of the ejection face of the recording head are specified by a form suitable for an ink to be used (whether or not to include water-repellent or hydrophilic properties and the like), and accordingly, the changes in the surface properties result in the changes in the ink ejection performance itself of the recording head.

In other words, it is possible to suppress a disadvantage of the accumulation of the ink residues by supplying the head liquid to dissolve the ink residues on the ejection face. However, the state where the dissolved matter of the ink residue by means of the head liquid is left on the ejection face cannot be said to be sufficiently cleaned. The desired surface properties of the ejection face are not maintained in such a state.

Patent Document 1: Japanese Patent Laid-Open No. 10-138503

Patent Document 2: Japanese Patent Laid-Open No. 2000-203037

Patent Document 3: Japanese Patent Laid-Open No. 10-138502

Patent Document 4: Japanese Patent Laid-Open No. 10-151759

Patent Document 5: Japanese Patent Laid-Open No. 11-254692

SUMMARY OF THE INVENTION

The present inventors found that, after supplying a head liquid containing a nonvolatile solvent on an ejection face to dissolve an ink residue on the ejection face, the head liquid and the ink residue are efficiently removed from the ejection face to sufficiently clean the ejection face, and thereby the surface properties of the ejection face were able to be maintained. The present inventors also found that the performance of wiping the ink residue is varied due to the relationships among the surface tension of the ejection face, the surface tension of the ink, and the surface tension of the head liquid.

Therefore, an object of the present invention is to appropriately specify the relative relationships among the ejection face, the ink and the head liquid to efficiently and surely remove the ink residue from the ejection face, and thereby to achieve the sufficient cleaning. Thus, the changes in the surface properties of the ejection face are suppressed, and thereby the original performance that the recording head has is maintained.

Therefore, according to the present invention, a method of cleaning a head for performing a cleaning of a surface of an inkjet head by supplying a head liquid to the surface and then by performing a wiping operation, the surface of the inkjet head provided with ejection openings through which an ink containing a color material is ejected, is characterized in that conditions of $F\gamma s<I\gamma s$ and concurrently $F\gamma s<R\gamma s$ are used, where a surface tension of the surface of the inkjet head is $F\gamma s$, a surface tension of the ink is $I\gamma s$, and a surface tension of the head liquid is $R\gamma s$.

According to the present invention, an inkjet recording apparatus comprising means for performing a cleaning of a surface of an inkjet head by supplying a head liquid to the surface and then by performing a wiping operation, the surface of the inkjet head provided with ejection openings through which an ink containing a color material is ejected, is characterized in that the inkjet head, the ink and the head liquid are used to satisfy conditions of $F\gamma s<I\gamma s$ and concurrently $F\gamma s<R\gamma s$, where a surface tension of the surface of the inkjet head is $F\gamma s$, a surface tension of the ink is $I\gamma s$, and a surface tension of the head liquid is $R\gamma s$.

In these, relationships among the surface tensions of the surface of the inkjet head, the ink and the head liquid may satisfy $F\gamma s<I\gamma s<R\gamma s$.

According to the present invention, by supplying the head liquid to the ink residue on the ejection face, the ink residue and the head liquid are mixed, and the ink residue is incorporated into the head liquid. At this time, since both surface tensions of the ink and the head liquid are higher than that of the ejection face, the wetting of the head liquid into which the ink residue is dissolved (dissolved matter of the ink residue) is reduced with respect to the ejection face, and thereby the head liquid moves smoothly by the wiping operation.

By preferably establishing the relationships of the surface tension of the ejection face <the surface tension of the ink <the surface tension of the head liquid, the ink residue having a low surface tension compared to the head liquid is dissolved in the head liquid having the higher surface tension. In other words, by allowing the ink residue to have a higher surface tension, the wetting with respect to the ejection face is reduced, and the ink residue is moved more smoothly by the wiping operations while being surrounded by the head liquid.

By the above approaches, the dissolved matter of the ink residue can be efficiently removed from the ejection face, and the changes in the surface properties of the ejection face are suppressed to maintain the original properties that the recording head has, and accordingly a stable image quality can be maintained.

Further features of the present invention will become apparent from the following description of exemplary embodiments (with reference to the attached drawings).

DESCRIPTION OF THE EMBODIMENTS

With reference to the drawings, the present invention will hereinafter be described in detail.

(Basic concept of the present invention)

Firstly described is that the performance of wiping an ink residue is varied in accordance with the relationships among the surface tension of an ejection face, the surface tension of an ink, and the surface tension of a head liquid.

Figure 1A:
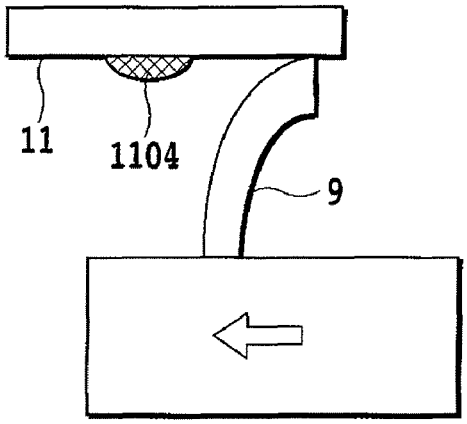
FIG. 1A is an explanatory drawing showing a behavior of an ink on an ejection face when wiping is performed by means of one wiper blade in the case where the surface tension of the ink is higher than that of the ejection face.
Figure 1B:
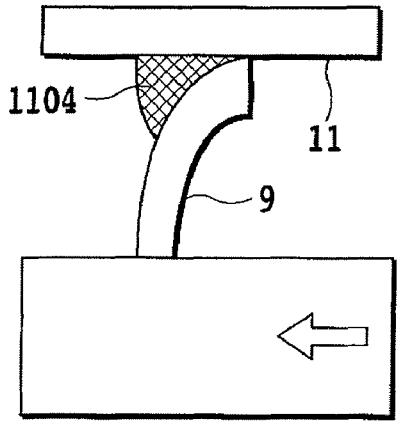
FIG. 1B is an explanatory drawing showing a behavior of the ink on the ejection face when wiping is performed by means of one wiper blade in the case where the surface tension of the ink is higher than that of the ejection face.
Figure 2:
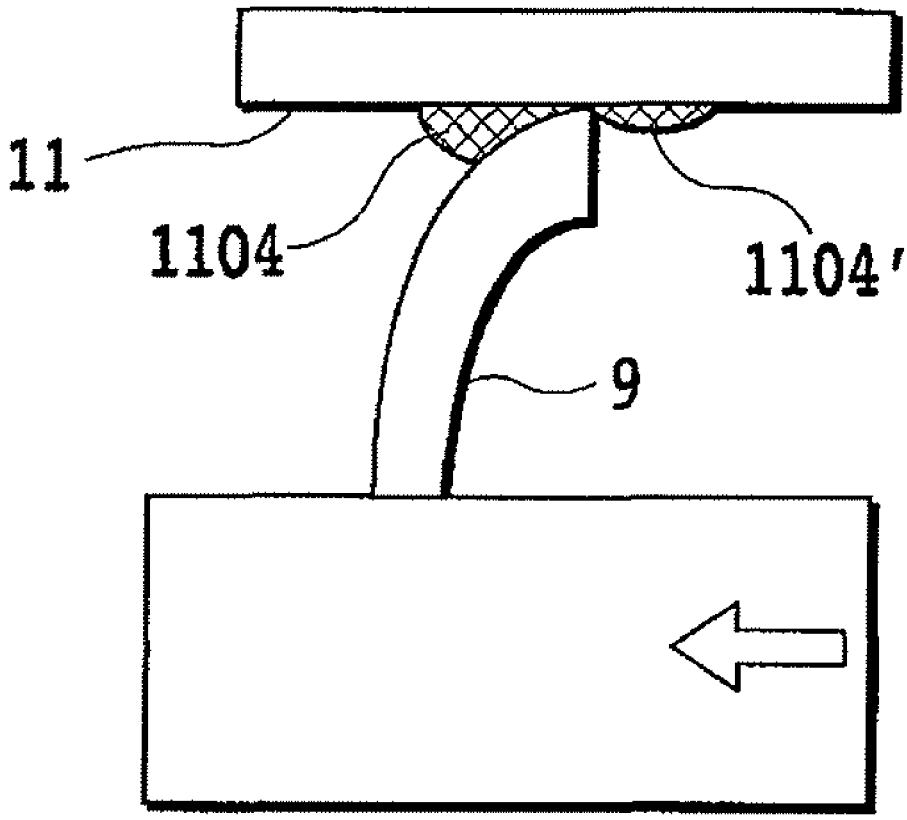
FIG. 2 is an explanatory drawing showing a behavior of an ink on an ejection face when wiping is performed by means of one wiper blade in the case where the surface tension of the ink is higher than that of the ejection face.

FIGS. 1A, 1B and 2 show behaviors of an ink on an ejection face when wiping is performed by means of one wiper blade in the case where the surface tension of the ink is higher than that of the ejection face. As shown in FIG. 1A, in the case where the surface tension of an ink is higher than that of an ejection face 1, a droplet of an ink residue 1104 on the ejection face maintains a relatively high contact angle to the ejection face 1. Thus, even when a head liquid is not supplied, a relatively favorable wiping can be performed by the movement of a wiper blade 9 in the direction indicated by an arrow as shown in FIG. 1B.

However, when a pigment, a high-molecular polymer, and the like are contained in the ink, a wiping residue 1104' of the pigment and the high-molecular polymer may be left on the ejection face 1 as shown in FIG. 2. Particularly, when the ink residue 1104 adhered on the ejection face 1 is evaporation-dried, the wiping residue tends to occur.

Thus, when the wiping residue is left, the pigment and the high-molecular polymer contained in the wiping residue 1104' are gradually deposited. Then, the pigment coagulates in the deposited matter. As a result, this is accumulated on the ejection face. When the coagulated matter of the pigment (pigment having an increased particle diameter) is peeled apart by performing wiping again in such a state, the ejection face 1 is scuffed by the coagulated matter of the pigment which has been peeled apart. Thus, the scuffing of the ejection face causes surface properties of the ejection face to change, resulting in an adverse effect on the ejection property in some cases.

In response, a disadvantage of the accumulation of the ink residues can be suppressed from occurring by supplying the head liquid to dissolve the ink residues on the ejection face. However, as described above, when the thin film of the high molecular compound dissolved by the head liquid is formed and has an increased viscosity, wiping by means of the wiper blade 9 becomes very difficult. Moreover, the surface properties of the ejection face are changed by the thin film, and thereby the ejection performance of the recording head is deteriorated.

To solve these problems, the present invention makes it possible to efficiently and surely remove the ink residue from the ejection face by appropriately specifying the relative relationships among the surface tensions of the ejection face, the ink and the head liquid. Thus, the present inventors found that the ink residue adhered to the print head can efficiently be removed even when a pigment ink is used to suppress the change (including damage) in the surface properties of the ejection face, and thereby sufficient cleaning can be achieved by satisfying the relationships of:

$$F\gamma s < I\gamma s \text{ and concurrently } F\gamma s < R\gamma s \quad (1)$$

where $R\gamma s$ is the surface tension of the head liquid, $F\gamma s$ is the surface tension of the ejection face, and $I\gamma s$ is the surface tension of the ink.

Furthermore, the present inventors found that it was more preferable to specify the relationships as:

$$F\gamma s < I\gamma s < R\gamma s \quad (2)$$

Figure 3A:
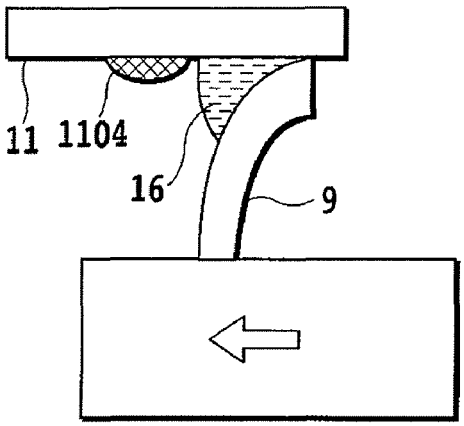
FIG. 3A is an explanatory drawing showing behaviors of an ink residue and a head liquid on an ejection face when wiping is performed by means of one wiper blade in the case where the relative relationships among the surface tensions of the ejection face, the ink and the head liquid are specified according to the present invention.
Figure 3B:
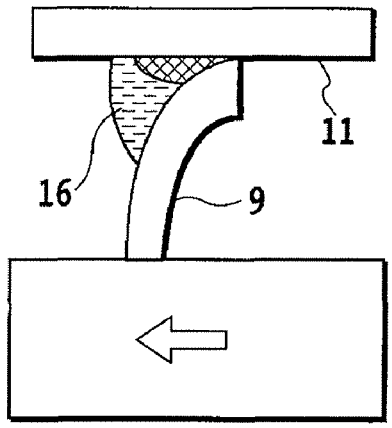
FIG. 3B is an explanatory drawing showing behaviors of the ink residue and the head liquid on the ejection face when wiping is performed by means of one wiper blade in the case where the relative relationships among the surface tensions of the ejection face, the ink and the head liquid are specified according to the present invention.

FIGS. 3A and 3B show behaviors of the ink residue and the head liquid on the ejection face when wiping is performed by means of one wiper blade in the case where the relative relationships among the surface tensions of the ejection face, the ink and the head liquid are specified as shown in the equation (1). When this specification is satisfied, both the ink residue 1104 and a head liquid 16 are present on the ejection face 11 in the state of a relatively low wetting as shown in FIG. 3A, and the head liquid 16 is smoothly moved while being pushed by the wiper blade 9. When the head liquid 16 contacts the ink residue 1104, the ink residue is dissolved in the head liquid. In this respect, since the both surface tensions of the ink and the head liquid are higher than that of the ejection face, the wetting of the head liquid in which the ink residue is dissolved is reduced with respect to the ejection face, and thereby the head liquid moves smoothly while being pushed by the wiper blade 9 as shown in FIG. 3B.

Particularly, when the specification is made as shown in equation (2), the ink residue having a low surface tension compared to the head liquid is dissolved in the head liquid having higher surface tension. In other words, the ink residue becomes the one having an increased surface tension, resulting in having reduced wetting with respect to the ejection face, and is pushed by the wiper blade 9 to smoothly be moved while being surrounded by the head liquid.

On the other hand, when the relationships indicated in equation (1) are not satisfied, for example, in the case of $I\gamma s < F\gamma s$, the ink residue tends to get wet with respect to the ejection face, and thereby the pushing by the wiper blade 9 is not smoothly performed, and the wiping residue tends to occur as shown in FIG. 2. In the case of $R\gamma s < F\gamma s$, the wiping residue of the head liquid itself in which the ink residue is dissolved is also left for the same reason. The disadvantages caused when such wiping residues are left are as described above.

In the illustrated inkjet recording apparatus, a carriage 100 is fixed to an endless belt 5, and is movable along a guide shaft 3. The endless belt 5 is wound on a pair of pulleys 503. The driving axis of a carriage driving motor (not illustrated) is connected to one of the pair of pulleys 503. Accordingly, the carriage 100 is caused to mainly scan along the guide shaft 3 reciprocally in the right and left directions in the drawing as the motor is rotatably driven. A cartridge-type recording head 1 which attachably and removably holds an ink tank 410 is mounted on the carriage 100.

By appropriately specifying the relative relationships among the surface tensions of the ejection face, the ink and the head liquid, as shown above, that satisfy the relationships of the equation (1), preferably (2), the changes (including damage) in the surface properties of the ejection face can be suppressed to enable sufficient cleaning to be achieved. Note that more specific example will be described below.

(Embodiment of Apparatus)

Figure 4:
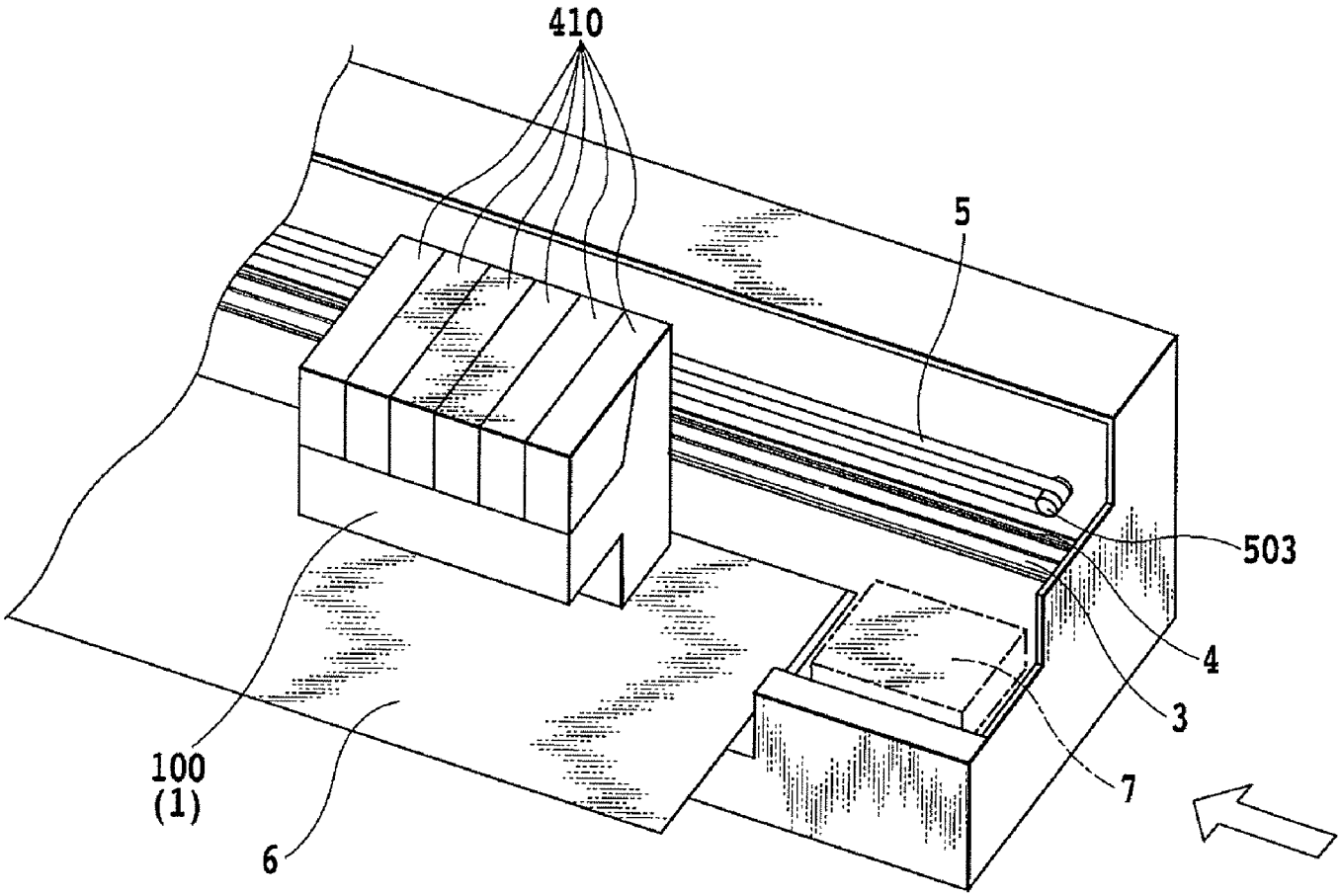
FIG. 4 is a diagrammatical perspective view of the main portion of an inkjet printer related to one embodiment of the present invention.

FIG. 4 is a diagrammatical perspective view of the main section of an inkjet printer related to an embodiment of the present invention.

In the illustrated inkjet recording apparatus, a carriage 100 is fixed to an endless belt 5, and is movable along a guide shaft 3. The endless belt 5 is wound on a pair of pulleys 503. The driving axis of a carriage driving motor (not illustrated) is connected to one of the pair of pulleys 503. Accordingly, the carriage 100 is caused to mainly scan along the guide shaft 3 reciprocally in the right and left directions in the drawing as the motor is rotatably driven. A cartridge-type recording head 1 which attachably and removably holds an ink tank 2 is mounted on the carriage 100.

Figure 5:
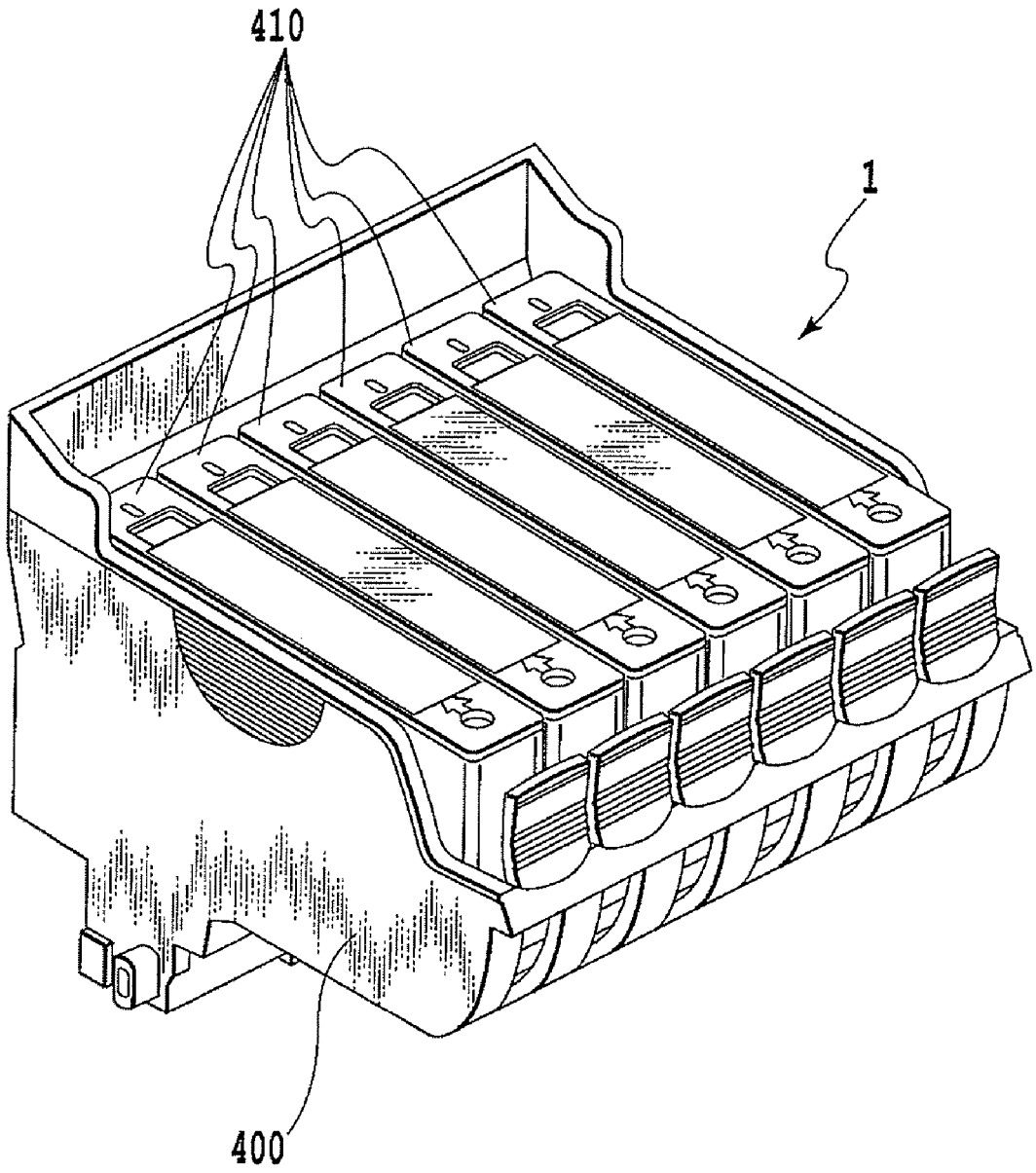
FIG. 5 is a perspective view showing one configuration example of a recording head which can be mounted to a carriage of the inkjet printer of the FIG. 4.
Figure 6:
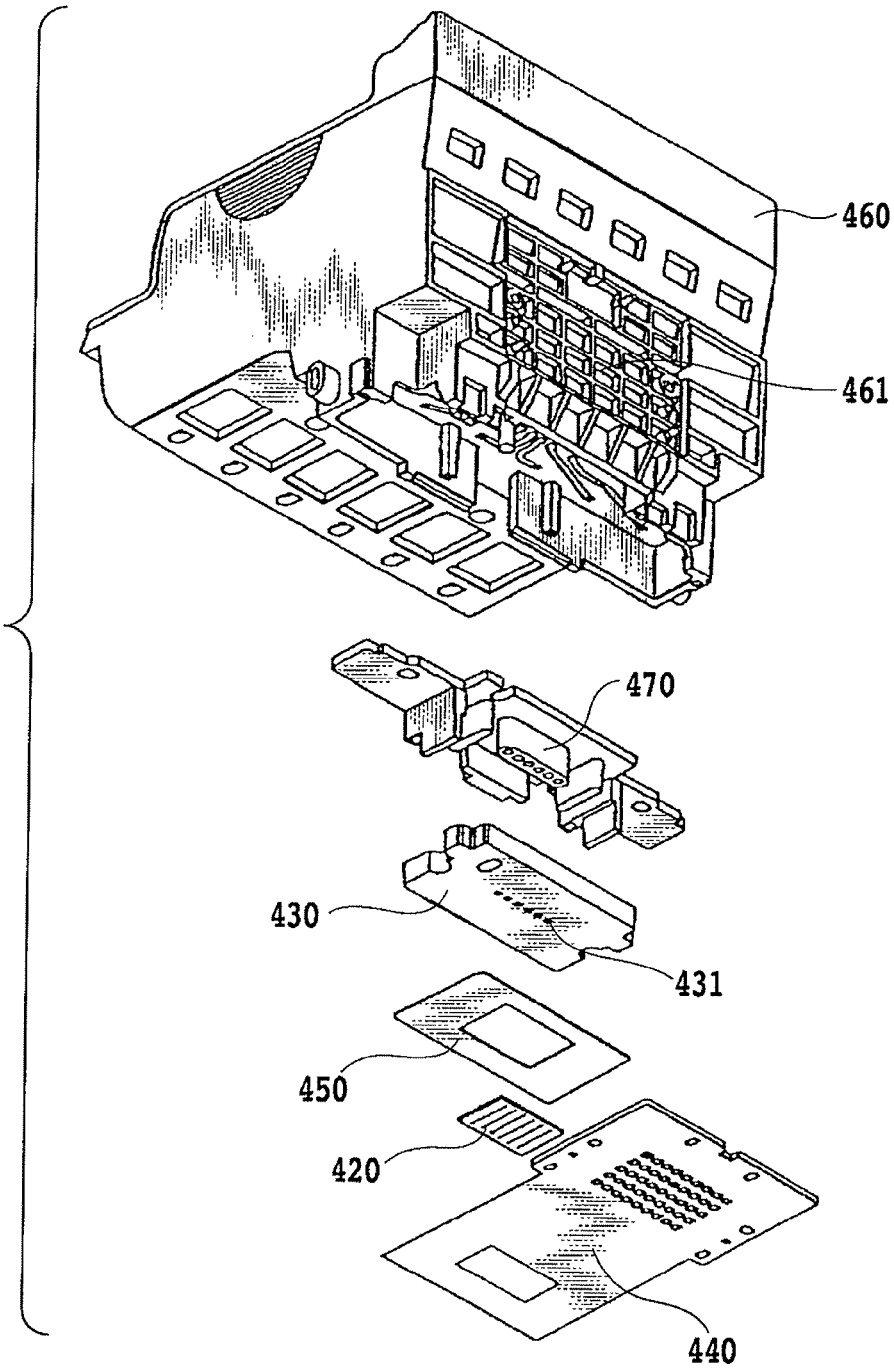
FIG. 6 is an exploded perspective view showing one configuration example of the recording head unit which is a component of the recording head of FIG. 5.

FIG. 5 is a perspective view showing one configuration example of the recording head 1 which can be mounted on the carriage 100 of FIG. 4. FIG. 6 is an exploded perspective view showing one configuration example of a head unit which is the component of the recording head 1.

The recording head 1 related to the present example includes a head unit 400 having arrays of ejection openings through which an ink is ejected, and ink tanks 410 each of which stores an ink and supplies the ink to the head unit 400. The recording head 1 is mounted on the carriage 100, so that ink ejection opening arrays provided to the head unit 400 faces to a paper sheet 6 which is a recording medium, and that the above array direction accords with a different direction (for example, sub-scanning direction which is the transporting direction of the recording medium 6) from a main scanning direction. A set of the array of ink ejection openings and the ink tanks 410 can be provided with the number corresponding to the number of the ink colors to be used. In the illustrated example, six sets are provided corresponding to six colors (for example, black (Bk), cyan (C), magenta (M), yellow (Y), pale cyan (PC) and pale magenta (PM)). In the recording head 1 shown here, the independent ink tanks 410 for each color are prepared, and each is attachable to and removable from the head unit 400.

As shown in FIG. 6, the head unit 400 is configured of a recording element substrate 420, a first plate 430, an electric wiring board 440, a second plate 450, a tank holder 460 and a flowpath formation member 470. The recording element substrate 420 having ejection opening arrays for respective color inks is adhesively fixed on the first plate 430 made of aluminum oxide ($Al_2O_3$) as a material. In the first plate 430, ink supply ports 431 are formed for supplying ink to the recording element substrate 420. The second plate 450 having an opening is furthermore adhesively fixed to the first plate 430. The second plate 450 holds the electric wiring board 440 so that the electric wiring board 440 which applies electric signals for ejecting an ink is electrically connected with the recording element substrate 420. On the other hand, the flow path formation member 470 is ultrasonically welded to the tank holder 460 attachably and removably holding the ink tank 410, and thereby an ink flow path (not illustrated) is formed across the ink tank 410 through the first plate 430.

Figure 7:
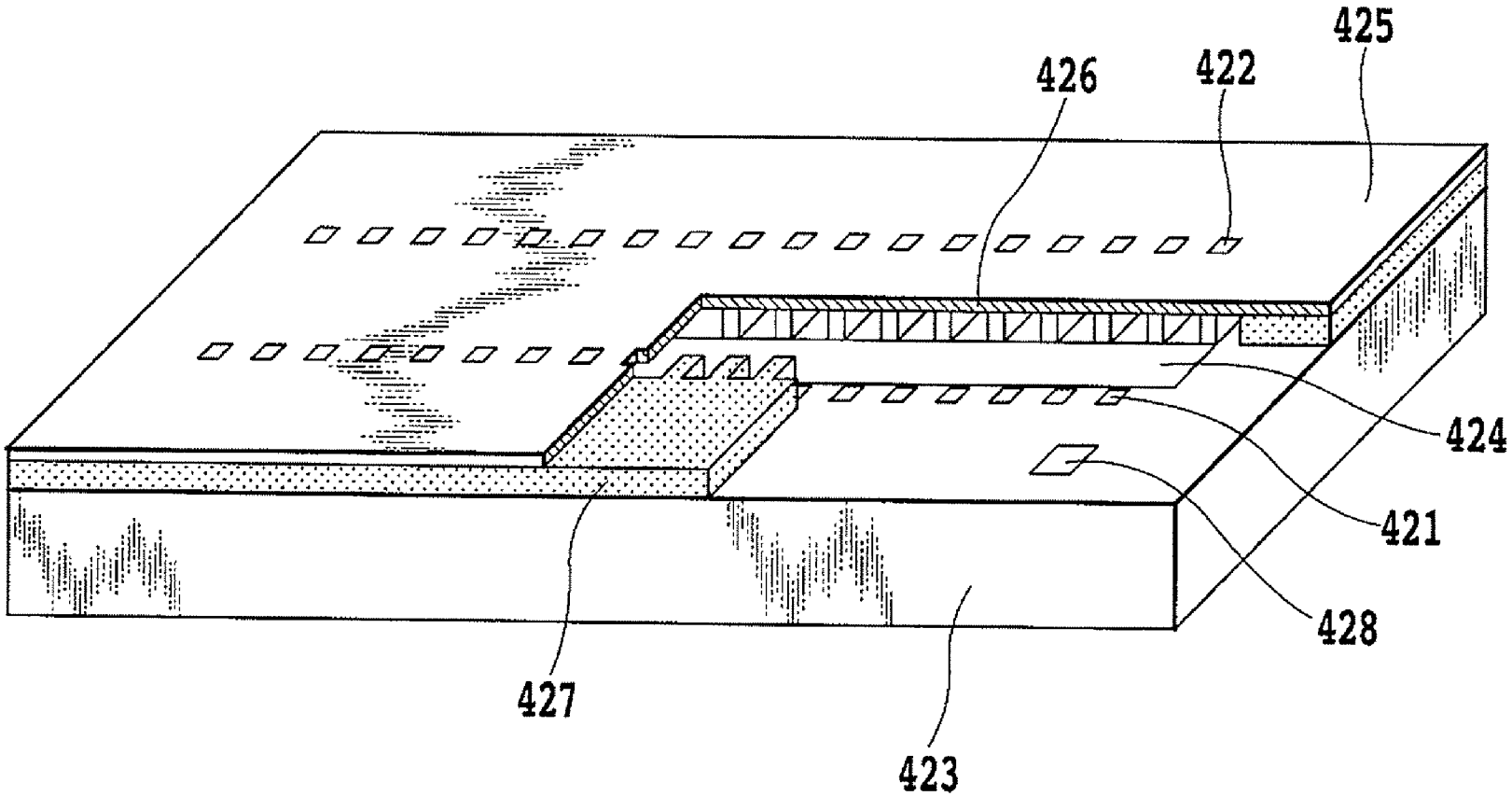
FIG. 7 is a partially ruptured perspective view showing a construction around ejection opening array for a single color on a recording element substrate used in the recording head of FIG. 6.

FIG. 7 is a partially ruptured perspective view showing the structure around the ejection opening array for a single color in the recording element substrate 420 shown in FIG. 6. In FIG. 7, a numeral 421 indicates a heat generation element (heater) which generates thermal energy which causes film boiling in an ink in accordance with the application of an electric current as energy utilized to eject an ink. A temperature sensor 428 for sensing the temperature of the head unit 400, and a sub-heater (not illustrated) for keeping the head or the ink warm in accordance with the detected temperature are provided on a base body 423 on which the heater 421 is mounted. A numeral 422 indicates an ink ejection opening, and a numeral 426 indicates an ink flow path wall. A numeral 425 indicates an ejection opening plate in which the ink ejection openings 422 are formed with a state facing to each heater. This plate is disposed on the base body 423 with a resin coated layer 427 interposed therebetween. Moreover, a desired water-repellent material is provided on the surface (ejection face facing to the recording medium) of the ejection opening plate 425.

In the present example, two lines of the heaters 421 or the ejection openings 422 are disposed, and the heaters 421 or the ejection openings 422 within each line are disposed so as to shift with each other by a half of array pitch in an array direction, i.e. sub-scanning direction. In this respect, by arraying 128 pieces of heaters 421 or ejection openings 422 per one line in a density of 600 dpi, a resolution of 1200 dpi is realized per one color of ink. Then, the configuration of the recording element substrate corresponding to the above six colors is disposed on the first plate 430.

A method of making a recording element substrate and an ejection face will be described by using FIGS. 8A to 8G.

Figure 8A:
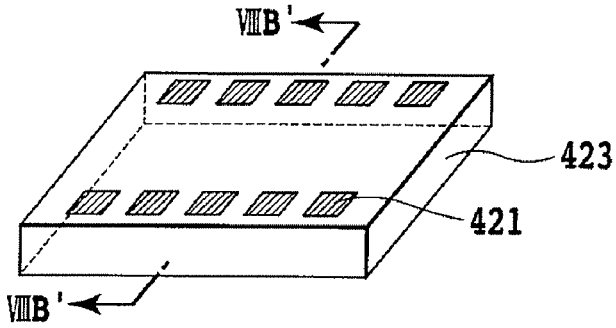
FIG. 8A is an explanatory drawing of a production step of the recording element substrate of FIG. 7.
Figure 8B:
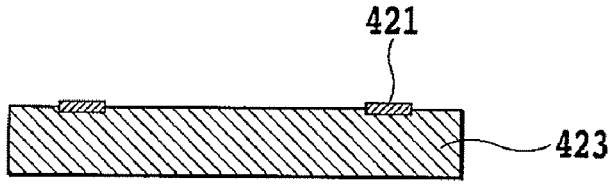
FIG. 8B is an explanatory drawing of the production step of the recording element substrate of FIG. 7.

FIGS. 8A and 8B are a diagrammatic perspective view of the recording element substrate 420 and a diagrammatic cross-sectional view thereof taken along the line VIIIB'-VIIIB', respectively. A plurality of heaters 421 is disposed on the base body 423 made of silicon and the like (an electrode and the like for applying a current to a heater are not illustrated).

Figure 8C:
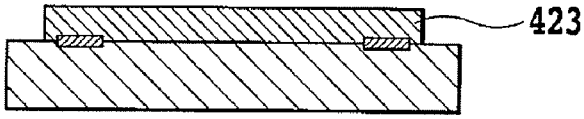
FIG. 8C is an explanatory drawing of the production step of the recording element substrate of FIG. 7.

FIG. 8C is a drawing in which an ink flow path pattern formation material 433 is disposed on the base body 423 shown in FIG. 8B using a positive type resist. The ink flow path pattern formation material 433 corresponds to a pattern for configuring a common liquid chamber for temporarily holding the ink which is supplied to each ejection opening, and ink flow paths which are branched in plural from the common liquid chamber to cause film boiling by the heater.

Figure 8D:
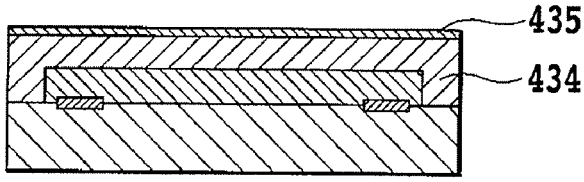
FIG. 8D is an explanatory drawing of the production process of the recording element substrate of FIG. 7.

FIG. 8D is a drawing showing the state where a nozzle formation material 434 made of a negative type resist and a water-repellent material 435 which is a negative type resist containing fluorine and siloxane molecules are formed on the ink flow path pattern formation material 433 shown in FIG. 8C. In the present embodiment, the ejection opening plate 425 is formed of these materials. The water-repellent property can be provided to the ejection face by using the water-repellent material 435 in the above manner. Alternatively, the ejection face can be changed to have desired surface properties in this step by changing a material which is to be combined with the nozzle formation material. Moreover, in a case where the water-repellent property is not necessary for the ejection face, the ejection face which does not have water-repellent property can be formed by not using a water-repellent material but using a nozzle material only.

Figure 8E:
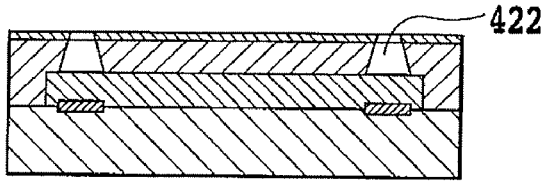
FIG. 8E is an explanatory drawing of the production step of the recording element substrate of FIG. 7.
Figure 8F:
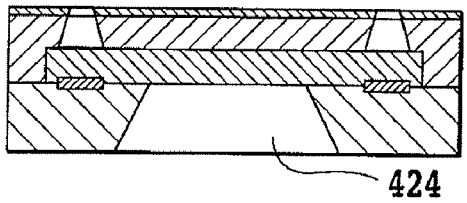
FIG. 8F is an explanatory drawing of the production step of the recording element substrate of FIG. 7.
Figure 8G:
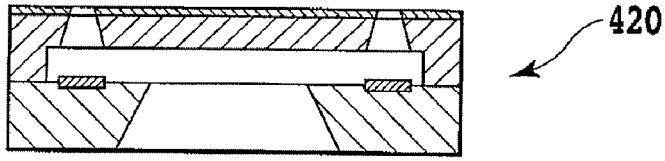
FIG. 8G is an explanatory drawing of the production step of the recording element substrate of FIG. 7.

FIG. 8E is a drawing showing the state where the ink ejection opening 422 and an ink path communicated therewith are formed by using a photolithography method, from the state of the FIG. 8D. Furthermore, FIG. 8F is a drawing showing the state where an ink supply port 424 is formed by anisotropically etching silicon from the back surface side of the base body 423 while the ejection opening formation surface side and the like are appropriately protected, from the state of the FIG. 8E. FIG. 8G shows the state where a recording element substrate is completed by eluting the ink flow path formation pattern material 433 from the state of FIG. 8F. The recording element substrate 420 thus completed is disposed on the first plate 430. Furthermore, the connection with and the electrical mounting on each section, for example, are performed, and thereby the configuration shown in FIG. 5 is obtained.

Referring once more to FIG. 4, the recording medium 6 is intermittently transported in the direction perpendicular to the scanning direction of the carriage 100. The recording medium 6 is supported by a pair of roller units (not illustrated) provided on the upstream side and the downstream side of the transport direction, respectively, imparted with a certain amount of tension, and then transported while maintaining flatness relative to the ink ejection opening. Recording across a width corresponding to the array width of the ejection openings of the head unit 1 in association with the movement of the carriage 100 and the transportation of the recording medium 6 are then alternately repeated, and thereby recording is performed on the entire recording medium 6. The illustrated apparatus is provided with a linear encoder 4 for the purpose of detecting the movement position of the carriage in the main scanning direction.

Figure 9:
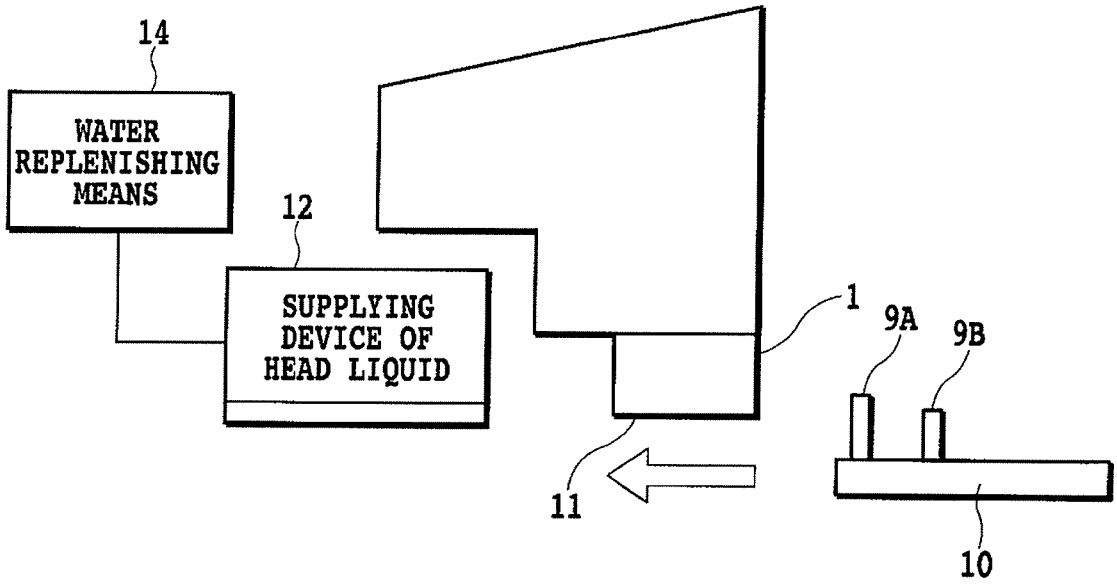
FIG. 9 is a diagrammatical side view showing one example of a cleaning device used in the printer of FIG. 4.

The carriage 100 stops at the home position as necessary at the time of starting recording or during recording. A cap and a maintenance mechanism 7 including a cleaning device described below in FIG. 9 are provided near the home position. The cap is supported in a manner capable of being ascended and descended. In an ascended position, the cap can cap the ejection face of the head unit 1, and thereby it is possible to protect the face at the non-recording operation time or to perform a suction recovery. At a recording operation time, the cap is set in a descended position to avoid the interference with the head unit 1, or it is possible to receive preliminary ejection by facing to the ejection face.

FIG. 9 is a diagrammatic side view showing an example of the cleaning device related to the present invention, and viewed from the direction indicated by the arrow of FIG. 4.

Wiper blades 9A and 9B made of an elastic member such as rubber and the like are fixed to a wiper holder 10. The wiper holder 10 is movable in the right and left directions (the direction which is perpendicular to the main scanning direction of the recording head 1, and in which the ink ejection openings are arrayed) shown in the drawing. The wiper blade 9A and 9B are different in height from each other. As a result, when slidingly contacting the ejection face 11 of the recording head 1, the former bends to a relatively large extent, thus causing the side section thereof to touch the ejection face 11, and the latter bends to a relatively small extent, thus cause the top end section to touch the ejection face 11.

A numeral 12 indicates a supplying device for transferring the head liquid by bringing the wiper blades into contact therewith, and can be in a form in which the head liquid is accommodated in a tank (container). Moreover, the supplying device can have an absorption body in at least a contact portion therewith, the absorption body holding a predetermined amount of the head liquid, while causing the head liquid to bleed out in accordance with the contact with the wiper blades. Furthermore, a stirring device or the like may be added thereto in order to obtain the uniformly mixed state of the head liquid. A numeral 14 indicates a water replenishing device which serves as a device for maintaining the performance of the head liquid. This equipment is disposed so that the head liquid maintains the range of the surface tension specified by the above equations (1) and (2) even when moisture evaporation occurs due to an extreme change in an environment in a case of using the head liquid containing water. This replenishing device is not necessary to operate as long as the head liquid maintains the state specified in the present invention. However, the surface tension can suitably be changed or maintained within the range which the present invention discloses in some desired conditions. Naturally, a case may be assumed where the head liquid loses the water content because an unexpected event occurs under normal circumstances such as the case where the head liquid is placed in an abnormal environment, or left in an inappropriate condition, and thereby the above specifications are not satisfied. In such a case, the head liquid is preferably used by replenishing with this means 14 to keep in the conditions within the range of the present invention.

In a cleaning operation, the head liquid first is transferred by bringing the wiper blades into contact with the supplying device 12 in a state where the recording head 1 is caused to stand by in a position apart from the home position, or before the recording head 1 is moved to the home position. Then, the wiper holder 10 is returned to the position shown in the drawing, and the recording head is set in the home position, and thereafter the wiper holder 10 is once more moved in the direction indicated by the arrow. In this moving process, to begin with, the relatively long wiper blade 9A first slidingly contacts the ejection face 11, and the relatively short wiper blade 9B follows this.

Figure 10:
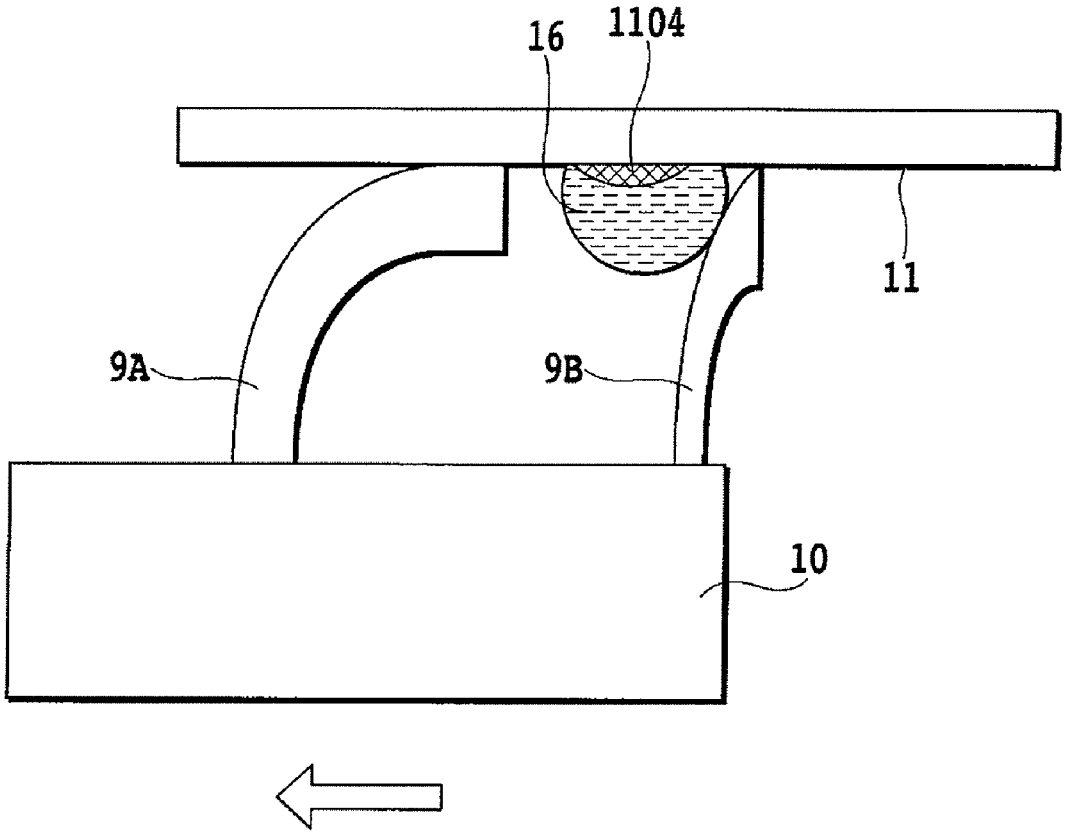
FIG. 10 is a diagrammatical drawing for explaining the operation of the cleaning device of FIG. 5.

FIG. 10 is an explanatory drawing of this process. The wiper blade 9A bends to a relatively large extent, and thus the side section (abdominal part) thereof slidingly contacts the ejection face 11 to efficiently transfer and apply the head liquid 16 to the ejection face 11. Even if there is an ink residue 1104 on the ejection face 11, the ink residue 1104 is dissolved by applying the head liquid 16. The amount to be applied is preferably within a range between 0.05 and 0.5 mg per one wiping operation. Then, the top end section (edge) of the wiper blade 9B touches the ejection face 11 in this state so as to efficiently scrape off the dissolved matter of the ink residue. Thus, the cleaning of the recording head is performed. At this time, the surface properties of the wiper blade 9B are set higher than the surface tension of the ejection face 11 (the wetting property thereof with respect to the ink is set higher than that of the ejection face). Thereby, the dissolved matter of the ink residue tends to move from the ejection face 11 to the wiper blade 9B, making it possible to efficiently remove the dissolved matter of the ink residue from the ejection face.

Note that, as a result of the wiping, the dissolved matter of the ink residue is attached on the wiper blade 9B. When this flows down along the wiper blade by the action of gravity, a member which receives this at the position below the illustrated wiper holder 10 can be provided.

However, it is desirable to provide means (a sponge, scraper, or the like) which touches the wiper blades 9A and 9B near the supplying device 12 to actively receive the dissolved matter from the wiper blades, or the above process, and thereby to clean the wiper blades. If the head liquid is transferred after the wiper blades 9A and 9B are made into a cleaned state, it is possible to prepare for the next wiping operation immediately.

The configuration for maintaining the performance of the head liquid is preferably employed in performing the cleaning described above as well. This is for the following reason. The material, shape, dimension, and position relative to the slidingly contacted target of the wiper blade 9A should have been determined so that a desired transferred amount can be obtained in association with the sliding contact with the supplying device 12 and the ejection face 11. In this respect, the transferred amount is an amount transferred from the supplying device 12 to the wiper blades and an amount transferred from the wiper blade 9A to the ejection face 11. In contrast, the desired transferred amount cannot be obtained when changes in weight and in physical properties of the head liquid caused by changes in environment are large, and thereby the reduction in the cleaning performance is likely to occur.

(Relationship between specifications of the present invention and wiper blades)

In the present invention, it is specified that the relative relationships among the surface tensions of the ejection face, the ink and the head liquid satisfy the above equation (1), and furthermore, it is preferable to satisfy the relationships of the above equation (2).

This enables the head liquid to surely be applied on the ejection face11, and to be mixed and stirred with the ink residue. Thus, the ink residue and the like which are fixedly adhered on the ejection face can easily be removed. Moreover, this effect allows the original surface properties (for example, water-repellent property) of the ejection face to be maintained even after a number of times of wiping operations are performed, and thereby the stable recording performance can be maintained over a long period of time. Furthermore, the effects of the present invention are available because the cleaning of the head is achieved without leaving the wiping residue even when an ink containing a high-molecular polymer is used to disperse pigment which serves as a color material, or when an ink containing a dye as a color material is used. Thereby, the stability of recording performance is improved.

The relationship between the specification of the present invention and the configuration of the wiper blade to be used is here described.

The preferred condition of the wiper blade is, firstly, to have favorable wetting property with respect to the ink. Secondly, it is to have a wetting property preferred to some extent with respect to the head liquid to remove the liquid from the ejection face 11 when the number of wiper blade is set one as shown in FIGS. 3A and 3B. The third condition is for a case where two wiper blades are used as shown in FIG. 10, the preceding wiper blade 9A applies the head liquid, and the following wiper blade 9B performs scraping operations. That is, this is a case where functions are separated. In this case, the wiper blade 9A desirably has a low wetting property with respect to the head liquid such that a large amount of the head liquid is left on the ejection face 11, and the wiper blade 9B desirably has a high wetting property with respect to the head liquid in which the ink residue is dissolved (ink residue mixed solution).

When two wiper blades are used as shown in FIG. 10, the specification of the equation (1) is to be satisfied, while it is only necessary to select the material of the wiper blade 9A in connection with the head liquid, and to select the material of the wiper blade 9B in connection with the ink residue mixed solution.

Meanwhile, when the number of wiper blade is set one as shown in FIGS. 3A and 3B, it is sufficient to make the surface tension of the ink residue mixed solution with respect to the ejection face higher than that in a case of the ink residue alone by satisfying the specification of the equation (2), and in addition to this, to select the material of the wiper blade 9 in connection with the ink residue mixed solution. In other words, the ink residue mixed solution has a higher surface tension than that in a case of the ink residue alone, resulting in having a larger difference in surface tensions from the ejection face than that in a case of the ink residue alone. Specifically, the wetting with respect to the ejection face becomes lower, making easier the movement of the ink residue mixed solution on the ejection face. Therefore, the ink residue mixed solution can easily be removed from the ejection face 11 as the wiper blade 9 moves.

In other words, in the present invention, by specifying the relationships of the equation (2) even in the configuration where one wiper blade is used, the ink residue having the low surface tension compared to the head liquid is dissolved in the head liquid having a higher surface tension. In such a manner, by obtaining the ink residue mixed solution having a higher surface tension, the wetting with respect to the ejection face is reduced. The ink residue mixed solution is smoothly moved while being pushed by the wiper blade 9. Therefore, even when an ink containing pigment, high-molecular polymer, or the like is used, the sufficient cleaning of the ejection face is made possible. In addition, by making the surface properties of the wiper blade 9 higher than the surface tension of the ejection face 11 (making the wetting property with respect to the ink higher than that of the ejection face), the dissolved matter of the ink residue tends to move from the ejection face 11 to the wiper blade 9. Thereby, the dissolved matter of the ink residue can efficiently be removed from the ejection face.

The effects of the present invention will be verified below by citing more specific example and comparative example.

EXAMPLE

Surface Tension

Firstly, here, explained is the surface tension described in the present specification.

The measurement of the surface tension of the ejection face (surface tension of a solid) was carried out by applying the wetting test standard solution (wetting reagent) described in JIS K6768-1971 on the ejection face using a cotton swab, and subsequently by observing a wetting reagent-repelling degree in the state immediately after the application (the state of "tailing" of the wetting reagent with the movement of the cotton swab at the time of application). The measurement method judged the wetting reagent to be "repelling" when the wetting reagent formed a round droplet immediately after the application, and to be "wetting" when the droplet immediately after the application was not a perfect circle. The measurement was carried out in order of the wetting reagent with low surface tension. The surface tension of the wetting reagent applied immediately before a wetting reagent which was firstly judged to be "repelling" was designated as the surface tension of the measured object, i.e. the ejection face.

Moreover, a surface tensiometer "CBVP-A3" available from Kyowa Interface Science Co., LTD. was used to measure the surface tensions of the ink and the head liquid.

The surface tensions of the recording head ejection face, the ink and the head liquid which are used in example to be described below are as follows.

Surface tension of the ejection face: $F\gamma s$=22 dyn/cm

Surface tension of the ink: $I\gamma s$=36 to 40 dyn/cm

Surface tension of the head liquid: $R\gamma s$=37 to 64 dyn/cm

Wiping Duration Test

A wiping duration test was carried out by using the following head liquid and ink, and by changing wiping conditions. Here, assuming the environment for the actual use, the operation of cleaning the ejection face was continuously repeated 5000 times using a printer in combination with a recording operation. Thereafter, the change in the surface properties of the ejection face was observed by evaluating the states of recording before and after the test.

Main Body for Evaluation

The main body used for evaluation was made by modifying the recovery system of an inkjet printer "PIXUS850i" available from Canon Inc. as shown in FIG. 4.

Head for Evaluation

The recording head used for evaluation was a recording head having an ejection face made of a water repellent material which was a negative type resist containing fluorine and siloxane molecules. The surface tension of the ejection face thereof was $F\gamma s$=22 dyn/cm.

Ink for Evaluation

The ink having the composition shown in Table 1 was attached in the color tank position of the recording head to perform the evaluation.

TABLE 1

Table 1

| | Composition | Ink i (self-dispersion + polymer) | Ink ii (dye + polymer) | Ink iii (resin dispersion pigment) |
|---|---|---|---|---|
| Solvent | Glycerin | 5% | 5% | 5% |
| | Diethylene glycol | 5% | 5% | 5% |
| Surfactant | Acetylenol EH··· (Note 1) | 0.2% | 0.2% | 0.2% |
| Color material | CABOJET 300 (solid content) (self dispersion pigment)··· (Note 2) | 4% | — | — |
| | CI. DBL: 199 (soluble dye) | — | 3% | — |
| | Pigment dispersion liquid 1··· (Note 3) | — | | 50% |
| Polymer | Styrene/acrylic acid copolymer (Molecular weight: 10000, Acid value: 100) | 2% | 1% | — |
| | Water | Remainder | Remainder | Remainder |
| | Surface tension | 38.0 dyn/cm | 36.0 dyn/cm | 40.0 dyn/cm |

(Note 1)
Trade name Acetylenol available from Kawaken Fine Chemicals Co., Ltd.
(Note 2)
Self-dispersion pigment available from CABOT Corporation
(Note 3)
A pigment dispersion liquid 1 prepared by the following method was used.

10 parts of carbon black having a specific surface area of 210 $m^2/g$ and a DBP oil absorption amount of 74 ml/100 g, 20 parts of 10% sodium hydroxide-neutralized aqueous solution of styrene-acrylic acid copolymer having an acid value of 200 and a weight-average molecular weight of 10000, and further 70 parts of ion-exchanged water were mixed. After the mixture was then dispersed for 1 hour using a sand grinder, rough and large particles were removed by means of a centrifugal separation process. Subsequently, the mixture was subjected to pressure filtration using a micro filter having a pore size of 3.0 μm (available from FUJIFILM Corporation) to obtain a pigment dispersion liquid 1 containing a resin dispersion type pigment. The obtained pigment dispersion liquid 1 had the values of physical properties of a solid content of 10%, a pH of 10.0 and an average particle diameter of 120 nm.

Head Liquid

The head liquids shown in Table 2 were used.

TABLE 2

Table 2

| Composition | Head liquid A | Head liquid B |
|---|---|---|
| Glycerin | 80% | 80% |
| Water | 20% | 19.9% |
| Acetylenol EH (above described Note 1) | 0% | 0.1% |
| Surface tension | 66 dyn/cm | 37 dyn/cm |

Wiping Conditions (1) Wiping conditions (1): The following two wiper blades were used as shown in FIG. 10. Note that a free length is the length from the foot to the top end of the wiper, and that an invasion amount is the height from the position equivalent to the ejection face to the top end of the wiper.

First wiper blade (corresponding to the wiper blade 9A, the abdominal part of which slidingly contacts the ejection face)

Material: Urethane, Hardness: 75°, Thickness: 0.5 mm, Width: 9 mm

Free length: 6 mm, Invasion amount: 1.75 mm

Second wiper blade (corresponding to the wiper blade 9B, the edge of which slidingly contacts the ejection face)

Material: Urethane, Hardness: 75°, Thickness: 0.5 mm, Width: 9 mm

Free length: 5 mm, Invasion amount: 0.6 mm (2) Wiping conditions (2): The following one wiper blade was used as shown in FIG. 4.

Material: Urethane, Hardness: 75°, Thickness: 0.5 mm, Width: 9 mm

Free length: 7 mm, Invasion amount: 1.2 mm (The abdominal part slidingly contacts)

Combination of Duration Test

Table 3 shows the combinations of the ink, head liquid, and wiping conditions for the above describe evaluation in each duration test.

TABLE 3

Table 3

| | Example test | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Ink | i | ii | iii | i | ii | iii | i | ii | iii | i | ii | iii |
| Head liquid | A | A | A | B | B | B | A | A | A | B | B | B |
| Number of wiper | 2 | 2 | 2 | 2 | 2 | 2 | 1 | 1 | 1 | 1 | 1 | 1 |

Evaluation Results

Evaluation was performed by observing the changes in the recording states before and after the duration test in a temperature condition of 25° C. At this time, a nozzle check pattern built in the main body of the printer was recorded on a high quality—exclusive paper to observe the misalignment (deviation) of the dot formation position. Evaluation was performed using the following three ratings.

O: A favorable printing is obtained without deviation in the nozzle check pattern (there is no difference from the printing quality obtained when a genuine ink is used in the main body of an unmodified printer.)

Δ: Deviations are occurred in a part of the nozzle check pattern.

x: Deviations are occurred in the entire area of the nozzle check pattern.

TABLE 4

Table 4

| | Example test | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Initial phase | ○ | ○ | ○ | ○ | ○ | ○ | ○ | ○ | ○ | Δ | ○ | Δ |
| After test | ○ | ○ | ○ | ○ | ○ | ○ | ○ | ○ | ○ | Δ | ○ | Δ |

A printing performance was maintained at a problem-free level of the actual use in all the combinations after the wiper operation was continuously repeated 5000 times in the above combinations in the example. In other words, substantial image deterioration such as non-ejection and deviations resulted from the receiving of a large number of pigment particles adhered on the ejection face or the deterioration of water-repellent property was not observed.

Comparative Example

Except that the ejection face was formed of a material for a nozzle made of a negative type resist as a comparative example but not formed of a water-repellent material, the same conditions as those of the above example were used to perform evaluation by employing a recording head for the comparative example which is equivalent to the head for evaluation used in the example. The surface tension of the ejection face of the recording head for the comparative example was Fγs=54 dyn/cm, did not satisfy the specifications of the equations (1) and (2).

The evaluation results of the comparative example tests are as shown in Table 5.

TABLE 5

Table 5

| | Comparative example test | | | | | | | | | | | |
|---|---|---|---|---|---|---|---|---|---|---|---|---|
| | 1 | 2 | 3 | 4 | 5 | 6 | 7 | 8 | 9 | 10 | 11 | 12 |
| Initial phase | ○ | ○ | ○ | ○ | ○ | ○ | ○ | ○ | ○ | Δ | ○ | Δ |
| After test | X | X | X | X | X | X | X | X | X | X | X | X |

From each test result in the comparative example, the deviations were observed in the entire area of the nozzle check pattern with respect to all the combinations after the wiping operations were continuously repeated 5000 times. Moreover, when the ejection face of the recording head used in the comparative example with a microscope was observed after the completion of the evaluation in the comparative example, the state where the mixture of the ink and the head liquid caused the ejection face to be nonuniformly wetted was found.

The observation results of this phenomenon will be described using FIGS. 11A to 11C. The surface tension of the ejection face used for the observation is Fγs=54 dyn/cm, the surface tension of the ink is Iγs=36 to 40 dyn/cm, and the surface tension of the head liquid is Rγs=66 dyn/cm. That is, these relationships do not satisfy the specifications of the present invention, and it is the case of Iγs<Fγs<Rγs.

Figure 11A:
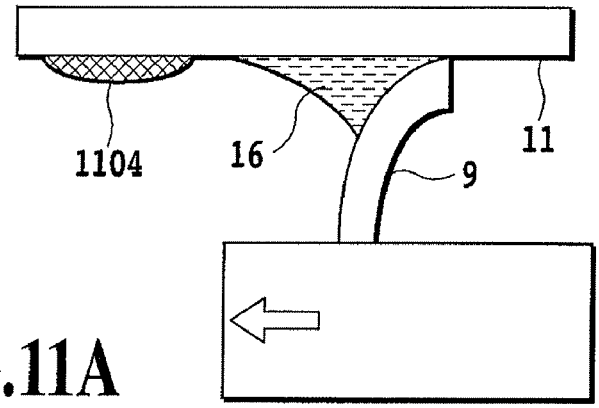
FIG. 11A is an explanatory drawing showing behaviors or states of an ink residue and a head liquid on an ejection face when wiping is performed by means of one wiper blade in the case where the relative relationships among the surface tensions of the ejection face, the ink and the head liquid do not conform to the specification according to the present invention.

FIG. 11A shows a diagrammatic drawing when wiping is performed by means of one wiper blade, and the ink residue 1104 and the head liquid 16 are present in the wetting states with respect to the ejection face 11. In this case, the wiper blade 9 slidingly moves on the head liquid because there is a wetting of the head liquid on the ejection face. As a result, a thin film of the head liquid is formed after the wiper blade 9 passes.

Figure 11B:
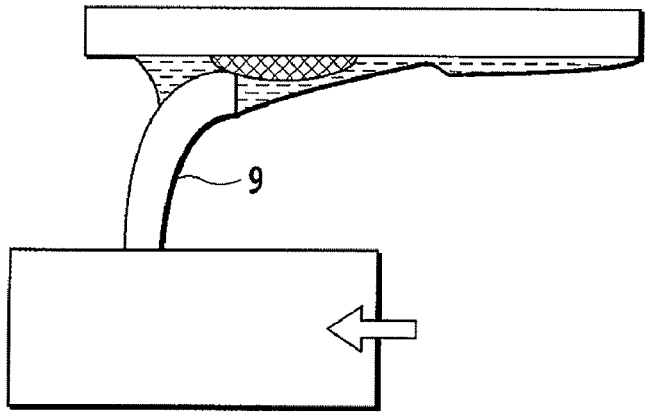
FIG. 11B is an explanatory drawing showing behaviors or states of the ink residue and the head liquid on the ejection face when wiping is performed by means of one wiper blade in the case where the relative relationships among the surface tensions of the ejection face, the ink and the head liquid do not conform to the specification according to the present invention.

FIG. 11B shows a state when the wiper blade 9 passes after the head liquid 16 is applied on the ink residue 1104 adhered to the ejection face 11. Here, the ink residue 1104 has high wetting property because the surface tension thereof is lower than that of the ejection face 11, and is adhered to the ejection face 11 in the extended form. For this reason, the head liquid 16 is applied on the extended ink residue when the head liquid 16 and the wiper blade 9 pass on the part where the ink residue is adhered. As a result, the extended ink residue and the head liquid are left on the ejection face.

Figure 11C:
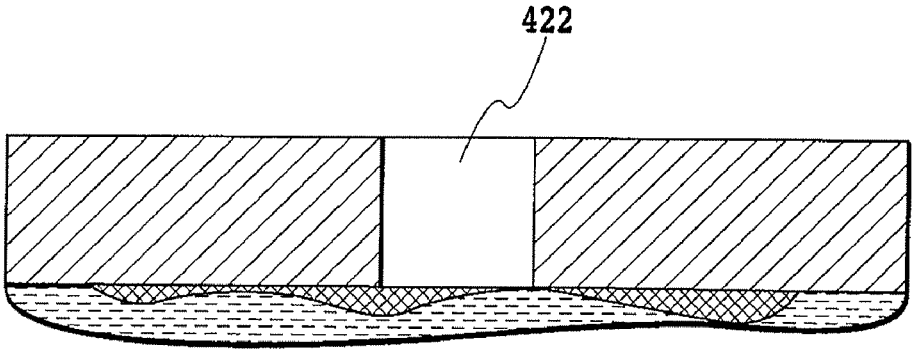
FIG. 11C is an explanatory drawing showing behaviors or states of the ink residue and the head liquid on the ejection face when wiping is performed by means of one wiper blade in the case where the relative relationships among the surface tensions of the ejection face, the ink and the head liquid do not conform to the specification according to the present invention.

FIG. 11C shows such a state. In this state, the ink component is nonuniformly present on the ejection face 11 such that a large amount of ink component is present on the part which the ink residue has been adhered to originally, and such that a large amount of the component of the head liquid is present on the part which the ink residue has not adhered to. If ink ejection operation is performed in the state where the nonuniform distribution of the ink components exists around the ejection opening 422, the ejected ink is drawn into the nonuniform position around the ejection opening, and is inhibited from going straight, resulting in a problem that the landing position is misaligned. Moreover, the ink component left on the ejection face is extended in a thin form on the ejection face, resulting in a problem that the inherent properties that the ejection face has are converted to the properties of the ink.

On the other hand, by using the configuration shown in the embodiment or example of the present invention, it is possible to clean the ejection face of the head even when a pigment ink is used. Therefore, a wiping residue which has an adverse effect on an ink ejection operation does not occur. As a result, it is possible to suppress the deterioration of the ejection face such as a scuff on the ejection face due to the adhesion of a polymer on the ejection face 11, and the flocculated matter of a pigment in association with repeated wiping operations can be prevented from occurring.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a continuation application of PCT application No. PCT/JP2005/023850 under 37 Code of Federal Regulations § 1.53 (b) and the said PCT application claims the benefit of Japanese Patent Application Nos. 2004-381749, filed Dec. 28, 2004 and 2005-235405, filed Aug. 15, 2005, which are hereby incorporated by reference herein in their entirety.

What is claimed is:

1. A method for performing a cleaning of a surface of an inkjet head comprising:

supplying a head treatment solution to the surface and then performing a wiping operation, wherein the head treatment solution is a liquid solution including water, a glycerin and a surface acting agent, wherein the surface of the inkjet head is provided with ejection openings through which an ink containing a color material is ejected, wherein conditions of Fγs<Iγs and concurrently Fγs<Rγs are used, where a surface tension of the surface of the inkjet head is Fγs, a surface tension of the ink is Iγs, and a surface tension of the head treatment solution is Rγs, and the head treatment solution is different from the ink, wherein Fγs<Iγs<Rγs, and wherein the surface of the inkjet head is water-repellant.

2. A method as claimed in claim 1, further comprising:

a first step of mixing and stirring the head treatment solution with an ink residue present on the surface by applying the head treatment solution on the surface by means of a wiper; and a second step of scraping a mixture of the head treatment solution and the ink residue.

3. A method as claimed in claim 2, wherein a first wiper is used in the first step and a second wiper is used in the second step.

4. A method as claimed in claim 1, wherein the ink contains a pigment as the color material.

5. An inkjet recording apparatus comprising an inkjet head, a head treatment solution, ink, and means for performing a cleaning of a surface of the inkjet head, the means being adapted to supply the head treatment solution to the surface and then perform a wiping operation, wherein the head treatment solution is a liquid solution including water, a glycerin and a surface acting agent, wherein the surface of the inkjet head is provided with ejection openings through which the ink containing a color material is ejected, wherein the inkjet head, the ink, and the head treatment solution satisfy conditions of $F\gamma s<I\gamma s$ and concurrently $F\gamma s<R\gamma s$, where a surface tension of the surface of the inkjet head is $F\gamma s$, a surface tension of the ink is $I\gamma s$, and a surface tension of the head treatment solution liquid is $R\gamma s$, and the head treatment solution is different from the ink, wherein $F\gamma s<I\gamma s<R\gamma s$, and wherein the surface of the inkjet head is water-repellant.

* * * * *